US005314197A

United States Patent [19]

Hersch

[11] Patent Number: 5,314,197

[45] Date of Patent: May 24, 1994

[54] GAME APPARATUS

[75] Inventor: Brian L. Hersch, Los Angeles, Calif.

[73] Assignee: Hersch & Company, Los Angeles, Calif.

[21] Appl. No.: 27,722

[22] Filed: Feb. 3, 1993

[51] Int. Cl.[5] ..... A63F 9/18

[52] U.S. Cl. ..... 273/430; 434/331; 434/405

[58] Field of Search ..... 273/429–432, 273/148 R, 148 A, 149 R; 434/327, 331, 348, 405, 404

[56] References Cited

U.S. PATENT DOCUMENTS

| | | | |
|---|---|---|---|
| 3,185,482 | 5/1965 | Russell . | |
| 3,248,050 | 4/1966 | Dickson | 434/331 X |
| 3,590,498 | 7/1971 | Landzerg | 434/327 |
| 3,929,339 | 12/1975 | Mattioli | 273/148 A |
| 3,986,275 | 10/1976 | Kleine-Horst . | |
| 4,175,336 | 11/1979 | Heck . | |
| 4,566,698 | 1/1986 | Sneden | 273/249 |
| 4,772,025 | 9/1988 | James et al. | 273/148 R |

FOREIGN PATENT DOCUMENTS

| | | | |
|---|---|---|---|
| 1425516 | 12/1965 | France | 434/348 |
| 2451078 | 11/1980 | France | 434/331 |
| 1168994 | 10/1969 | United Kingdom | 434/348 |

*Primary Examiner*—Paul E. Shapiro
*Attorney, Agent, or Firm*—Larson & Taylor

[57] ABSTRACT

Game apparatus in which a pawl and ratchet mechanism indexes a game card to bring successive game indicia to a viewing opening, said indicia comprising intelligible indicia interspersed with unintelligible indicia, said intelligible indicia being intelligible only when viewed through a colored filter in said opening, the game being played by teams of two players, one of whom views said indicia and gives the other player clues for identifying the information in the indicia.

9 Claims, 2 Drawing Sheets

GAME APPARATUS

BACKGROUND OF THE INVENTION

The present invention relates to game apparatus involving teams of two players, one of whom gives clues to the identify of a person or thing, while the other player guesses the identity, based on the clues given. Game cards bear the information, which is visible, but unintelligible, except when viewed through a window in the apparatus. The apparatus utilizes pawl and ratchet means to bring successive indicia into view through the window.

PRIOR ART

Pawl and ratchet means are of course well known, for example in playing card distributors as shown in U.S. Pat. No. 3,929,339, issued Dec. 30, 1975. Bridge game instruction apparatus using cards bearing instructional information which is viewed through windows as the card is moved through a holder, is disclosed in U.S. Pat. No. 4,175,336, issued Nov. 27, 1979. In U.S. Pat. No. 4,772,075, issued Sep. 20, 1988, an elongated card bearing a series of lottery numbers is moved by a crank and roller to display successive numbers through a window.

U.S. Pat. No. 4,566,698, issued Jan. 28, 1986, discloses a character identification game in which successive clues on a card are displayed through openings in a holder as covers over the respective windows are opened serially.

Information bearing instructional cards are also shown in U.S. Pat. No. 3,986,275, issued Oct. 19, 1976.

None of the above-referenced patents discloses pawl and ratchet indexing of an indicia bearing card to bring successive indicia into view, nor do they teach the intermingling of intelligible and unintelligible indicia such that the unintelligible can be read only through a special window.

SUMMARY OF THE INVENTION

Basically, the game apparatus comprises a card reader housing an opening in a side wall for receiving a game card which bears along its length a plurality of names of people or things, the names being interspersed with unintelligible indicia such that the names can be read only when viewed through a window on the front cover of the apparatus. The intelligible names and the unintelligible indicia are of two different colors and the window has a filter of the color of the unintelligible indicia, so that only the names are seen when the card is viewed through the filter. A pawl mechanism in the housing cooperates with ratchet means on a card carrier to index the card to successive names.

The game is played by teams of two players, one of whom views the names and gives the other player clues for identifying the person or thing seen on the card through the window. Teams are selected from a score pad on which each player receives an identifying number, the score pad being mounted on a holder along side a slot which receives a player assignment card bearing numbers identifying the respective teams. A pointer slideable along the slot identifies the clue giver and the guesser of each team.

The foregoing will be explained in further detail in the following detailed description of a preferred form of the invention, read in conjunction with the appended drawings.

DETAILED DESCRIPTION OF A PREFERRED EMBODIMENT

Figure 1:
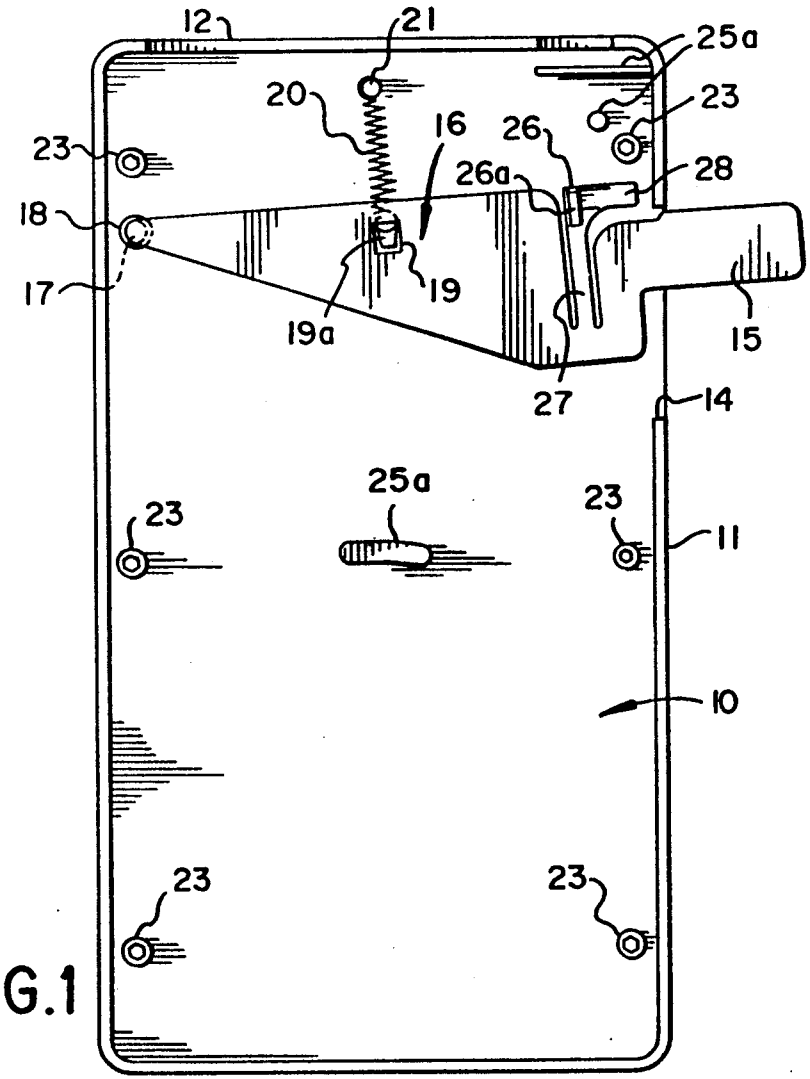
FIG. 1 is a perspective view showing the open interior of the bottom cover of the card viewer.
Figure 4:
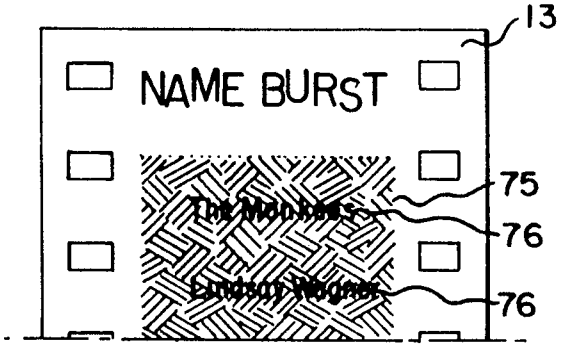
FIG. 4 is a front plan view of a portion of a card.

Referring now to FIG. 1, numeral 10 designates the bottom cover of the housing for the card viewer. It is made of a moldable material such as polystyrene. It has an upstanding rim 11 around its edges, forming side walls, the rim being interrupted at the upper end by a depression 12 which forms an opening for receiving a game card 13 (FIG. 4). On the right-hand side of the bottom cover there is provided a notch 14 through which handle portion 15 of pawl lever 16 projects.

Pawl lever 16 comprises a flat piece of polypropylene copolymer having at the end opposite handle 15, a downwardly extending integral pin 17 shown in dotted lines at the left side of FIG. 1. Pin 17 fits rotatably into an upwardly extending hollow post 18 integral with cover 10, to provide a pivot hinge for the pawl lever. Near the center of pawl lever 16 is a small opening 19 having a downwardly projecting integral tab **19*a* to which is hooked one end of a coiled tension spring 20, the other end of which is hooked around an upstanding post 21 integral with bottom cover 10. Spring 20 constitutes biasing means urging pawl lever 16 upwardly to engage the upper edge of notch 14 to the position shown in FIG. 1**.

Figure 5:
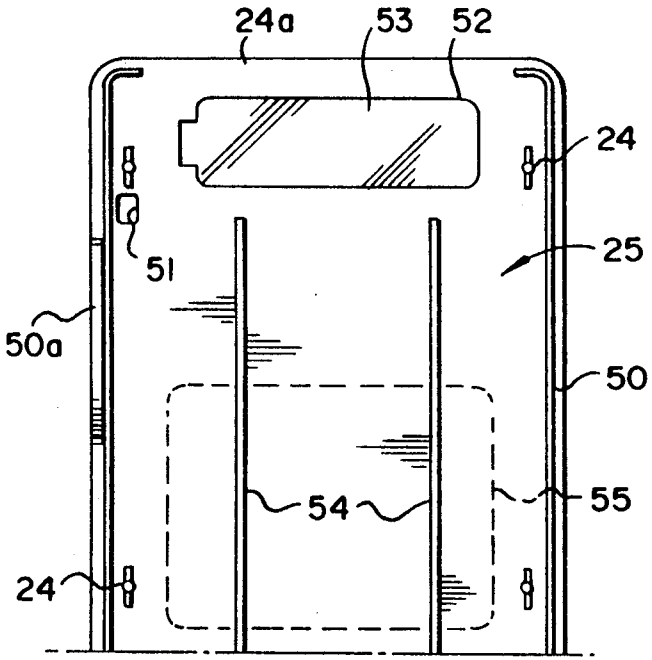
FIG. 5 is a bottom plan view of a portion of the top cover, showing the window.

Bottom cover 10 has six hollow posts 23 spaced about its interior to provide support for other parts and to receive mounting pins 24 correspondingly located on the interior surface of front cover 25 (FIG. 5). Bottom cover 10 also has other integral support projections shown at **25*a***.

Returning now to pawl lever 16, it will be seen to have a pawl tooth 26 integral with a narrow tongue 27 which is integral with lever 16. Tooth 26 has a vertical surface facing toward depression 12, and a sloping face **26*a*. Tongue 27 is bendable and has a sidewardly extending projection 28**.

Figure 2:
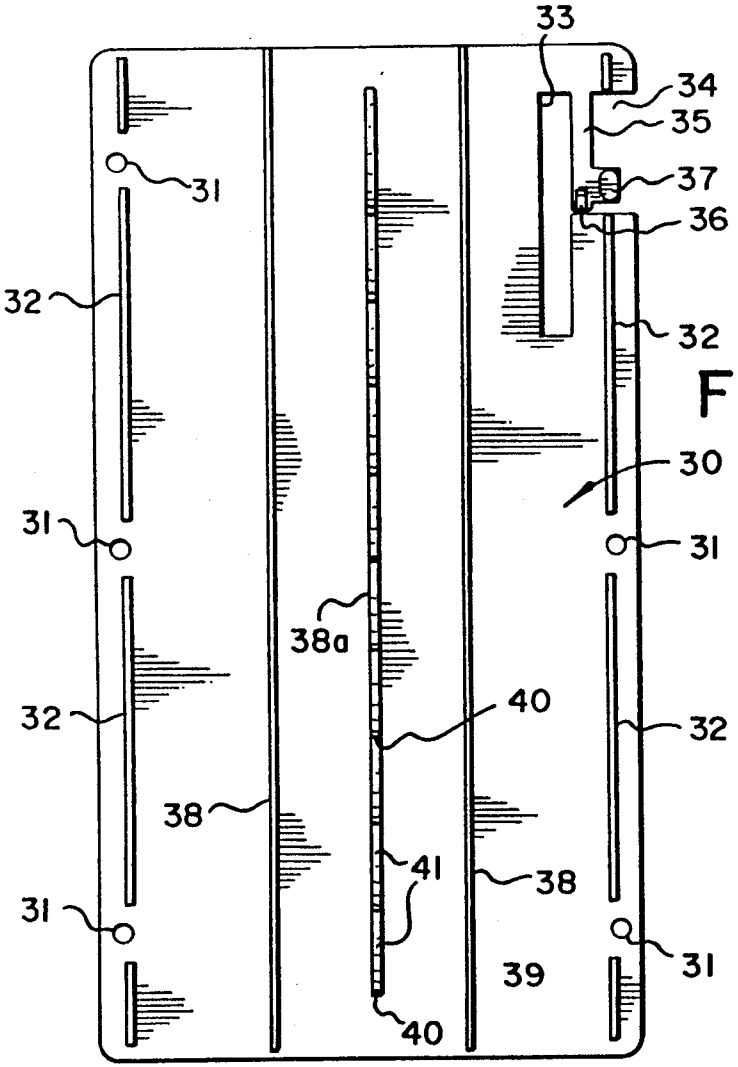
FIG. 2 is a front perspective view of the platform that is mounted on the bottom cover.

FIG. 2 shows a front view of platform 30, molded of polypropylene copolymer, which, when the apparatus is assembled, sits on posts 23 and projections **25*a*. It has holes 31 which align with the holes in hollow posts 23, and upstanding guide ribs 32 which are interrupted at the regions of holes 31**.

At its upper right-hand corner, platform 30 has spaced openings 33 and 34. Space 33 is shaped as an elongated rectangle and is located over pawl tooth 26, while opening 34 is located over one of the hollow posts 23 so as not to block the corresponding pin 24 in the front cover (FIG. 5).

An integral flexible tongue 35 lies between openings 33 and 34 and carries near its lower, moveable end, a small tooth 36 which will lie alongside tooth 26 (FIG. 1) of the pawl mechanism, and an upwardly extending integral post 37 which serves as a reset button, positioned to overlie projection 28 on lever 16 (FIG. 1).

The front side of platform 30 has two spaced tracks 38 which extend a much smaller distance from the surface of the platform than ribs 32. Centered between tracks 38 is another track 38*a* which has nine shallow vertical stop surfaces 40, each adjacent a ramp surface 41 which slopes toward the surface of platform 30 as shown in somewhat exaggerated perspective in FIG. 2.

FIG. 5 shows the back of front cover 25, which is molded of the same material as bottom cover 10. Front cover 25 has ribs 50 extending around its back surface except at the side 24*a* where it overlies depression 12 on the bottom cover. Ribs 50 are offset slightly from the edge of cover 25 except at the location of notch 14 (FIG. 1), where portion 50*a* of rib 50 aligns with rim 11 of bottom cover 10 and extends into notch 14 far enough to leave a narrow opening through which lever handle 15 extends. The remainder of rib 50 fits closely inside rim 11 of the bottom cover.

Front cover 25 has a small opening 51 which aligns with post 37 on the platform and renders the post accessible for manual operation as a reset button from outside the card viewer. Cover 25 also has a window opening 52 near the upper side 24*a*. A transparent red filter 53 is secured in window 52. Spaced rails 54 extend a short distance from the inner surface of the front cover. A depressed area 55 in the outer surface of cover 25, for receiving a label, is indicated in broken lines.

Figure 3:
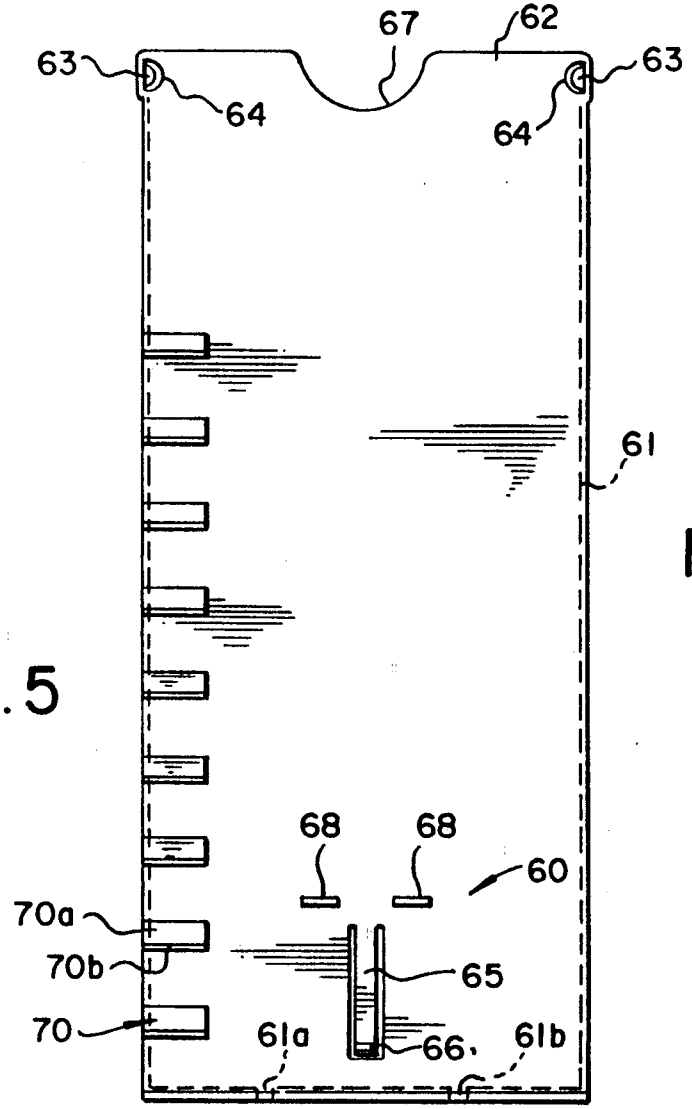
FIG. 3 is a plan view of the back of the card carrier.

FIG. 3 shows the bottom surface of a card carrier 60 which has on its reverse surface a rib 61 (broken lines in FIG. 3) extending around three of its sides with the upper end 62 for receiving a card 13 (FIG. 4) so that the card 13 is retained on the card carrier by the rib 61 extending around the three sides. Rib 61 is interrupted at 61*a* and 61*b* to receive rails 54 (FIG. 5) on the back surface of front cover 24. Two tabs 63 on the front of the card carrier (seen through openings 64) extend inwardly toward each other from rib 61 near end 62, to receive a game card 13 between the tabs and the front surface of card holder 60. A small resilient tongue 65 has a small tooth 66 projecting from the back side of the card holder to cooperate with track 38*a* (FIG. 2) on the platform 30. Two small, spaced projections 68 near tongue 65 help guide the card holder along track 38*a*. The card holder has a finger grip indentation 67 on the upper end of card carrier 10 between tabs 63 to facilitate withdrawing a card from the holder.

FIG. 3 also shows ratchet teeth 70 integral with the back side of the card holder. These teeth lie along a side edge of the card in a location were they cooperate with tooth 26 on lever 16 (FIG. 1). Each tooth 70 has a ramp face 70*a* sloping downwardly in the direction of tabs 63 toward the surface of card holder 60, and a vertical stop surface 70*b* facing in the opposite direction so that when handle 15 of pawl lever 16 is moved downwardly, pawl tooth 26 will slide on ramp face 70*a* and will snap into engagement with vertical surface 70*b*. When the handle 15 is released spring 20 will move the card holder upwardly to the next position of the card holder.

A portion of game card 13 is shown in FIG. 4. Card 13 has a centrally located indicia area 75 having a background of red lines randomly disposed with the background containing indicia 76 which is extremely difficult to read. However, when the card 13 passes beneath the red filter 53 the red lines disappear and the indicia 76 is readily apparent. All that can be seen when viewing the card without the filter are random marks, all completely unintelligible because of the random red background lines.

Card 13 is dimensioned to fit between tabs 63 of card holder 60 and to fit in the slight depression formed by rib 61 on the front side of the card holder. Card 13 and card holder 60 constitute game card means.

ASSEMBLY

To assemble the parts described above, pawl mechanism 16 and spring 20 are mounted in bottom cover 20. Platform 30 (FIG. 2) is then placed in bottom cover 10 with holes 31 of the platform overlying the holes in posts 23. When thus positioned, post 37 overlies projection 28 on pawl 16 and pawl tooth 26 projects through and above the surface of platform 30.

Front cover 25 is then placed over platform 30 with pins 24 entering the holes in posts 23. A solvent or adhesive may be used to retain the pins firmly in the holes. Post 37 projects through hole 50 in the front cover and is thus available for manual depression.

A card 13 is selected and slid into card holder 60 with the card edges between tabs 63 on the front side of the card holder. The card holder is then inserted into the opening formed by depression 12 in the bottom cover, sliding between the upper surface of platform 30 and the bottom surface of front cover 24. Tracks 38 on platform 30 and rails 54 on front cover 25, as well as ribs 32, guide the insertion, as do projections 68 (FIG. 3) cooperating with track 38*a*. Rib interruptions 61*a* receive rails 54. When so inserted, the card and its indicia face up and the first legible indicia 76 is legible through window filter 53.

OPERATION

With a card holder 60 and card 13 carried thereby thus inserted, the holder and card can be indexed to place successive legible indicia 76 under window 52. This is done by moving lever handle 15 downwardly against the bias of spring 20 and then releasing the lever to move back to the position shown in FIG. 1. As pawl 16 moves downwardly, sloping surface 26*a* of the pawl causes the tooth to be cammed downwardly as it passes over ramp face 70*a* of a ratchet tooth 70, due to the resilience of tongue 27 which carries tooth 26. As spring 20 moves lever 16 to its original position, the vertical surface of tooth 26 engages the vertical surface 70*b* of the first ratchet tooth 70 on card holder 60 and indexes the card holder one step. This operation is repeated when the user desires to index to a new line of intelligible indicia.

Removal of a card holder is accomplished by manual depression of reset button 37, which presses downwardly on projection 28, thus moving pawl tooth 26 to inoperative position.

THE GAME

After players are assigned numbers by a score pad, the first team inserts a card 13 in card holder 60. As pointed out above, the indicia on the card is meaningless until viewed through filter 53, hence the team selects a card at random. When the card and card holder are inserted into the card viewer through the opening at depression 12, a timer is started.

One player of the team (the giver) holds the card viewer and gives the other player (the guesser) cues intended to help the guesser name the person or object seen by the giver in the card viewer. Once the guesser gives the right name or gives up, lever 16 is operated to index the card holder and card to the next name. A point or points are awarded for success and subtracted for failure. Each team has a specific amount of time to complete the card with which it is working.

The invention has been described with reference to a preferred embodiment, but it will be appreciated that a variety of modifications can be made without departing from the spirit of the invention.

What is claimed is:

1. Game apparatus comprising:

game card means for carrying game indicia having a plurality of intelligible game indicia spaced therealong, said game indicia being interspersed with nonintelligible indicia whereby said game indicia can be read only when viewed through a window in the apparatus;

a housing comprising side walls and a front cover, one of said side walls having an opening for receiving said game card means, said front cover having a window for viewing said game indicia on said game card means;

ratchet means on said game card means; and pawl means in said housing cooperating with said ratchet means for indexing said game card means to bring successive ones of said game indicia into play.

2. Game apparatus as set forth in claim 1 wherein:

said housing further comprises a bottom cover, said pawl means being pivotally mounted on said bottom cover; and said pawl means further comprises an operating handle extending outside said housing, biasing means urging said pawl means toward said side wall opening, and a bendable portion carrying a pawl tooth extending toward said front cover for engaging said ratchet means.

3. Game apparatus as set forth in claim 2, further comprising:

platform means in said housing overlying said pawl means and having a flexible portion overlying said bendable portion of said pawl means, said platform means providing support for said game card means, an elongated post on said flexible portion, extending toward and through said front cover for manual depression by a player to disengage said pawl tooth from said ratchet means, and said platform means having an opening through which said pawl tooth extends for engaging said ratchet means.

4. Game apparatus as set forth in claim 3, said platform means further comprising upstanding ribs for guiding said card means.

5. Game apparatus as set forth in claim 1, further comprising:

said nonintelligible indicia being of a first color with a background of a second color, and said window having a filter of said second color which causes said nonintelligible indicia to be visible, when said indicia are viewed through said filter.

6. Game apparatus as set forth in claim 5, further comprising:

said first color being black and said second color being red.

7. Game apparatus as set forth in claim 1, further comprising:

manual release means for disabling said pawl means to permit withdrawal of said game card means.

8. Game card means for use in a game apparatus having pawl means comprising:

a card bearing a plurality of intelligible indicia of a first color spaced along said card, said intelligible indicia being interspersed with nonintelligible indicia of a second color, said intelligible indicia being intelligible only when viewed through a filter of said second color; and an elongated card carrier having a rear surface bearing ratchet means for indexing cooperation with said pawl means, said card carrier having guide means on its front surface for receiving said game card.

9. Game card means as set forth in claim 8, wherein said first color is black and said second color is red.

* * * * *